United States Patent [19]

Peters et al.

[11] Patent Number: 4,474,411

[45] Date of Patent: Oct. 2, 1984

[54] GUIDES FOR MINERAL MINING MACHINES

[75] Inventors: Wolfgang Peters, Selm; Christoph Rassmann; Gerhard Merten, both of Lünen, all of Fed. Rep. of Germany

[73] Assignee: Gewerkschaft Eisenhutte Westfalia, Lünen, Fed. Rep. of Germany

[21] Appl. No.: 318,142

[22] Filed: Nov. 4, 1981

[30] Foreign Application Priority Data

Nov. 8, 1980 [DE] Fed. Rep. of Germany ..... 3042203

[51] Int. Cl.[3] ..... E21C 35/12

[52] U.S. Cl. ..... 299/43

[58] Field of Search ..... 299/34, 42, 43

[56] References Cited

U.S. PATENT DOCUMENTS 4,067,619 1/1978 Peters et al. ..... 299/43
4,108,495 8/1978 Hauschopp et al. ..... 299/43

FOREIGN PATENT DOCUMENTS 2847516 5/1980 Fed. Rep. of Germany ..... 299/43
3005336 8/1981 Fed. Rep. of Germany ..... 299/34
1085769 of 1967 United Kingdom ..... 299/34
1171510 of 1969 United Kingdom ..... 299/34
1515981 6/1978 United Kingdom ..... 299/43

*Primary Examiner*—Stephen J. Novosad
*Assistant Examiner*—William P. Neuder
*Attorney, Agent, or Firm*—Thompson, Birch, Gauthier et al.

[57] ABSTRACT

A guide for mineral mining machines is composed of assemblies each secured to the mineral face side of a conveyor. The assemblies have angle plates secured to the side walls and structures formed with spacers separating upper and lower passages for a drive chain. Covers are detachably and pivotably mounted to the structures. The covers can be secured in a closed position covering the upper passage or swung outwardly to an open position on push-in hinge joints formed at their lower regions by interengaging components of the covers and the structures. The hinge joints have complementary projections and recesses which interengage when the covers are closed.

15 Claims, 9 Drawing Figures

FIG. 4
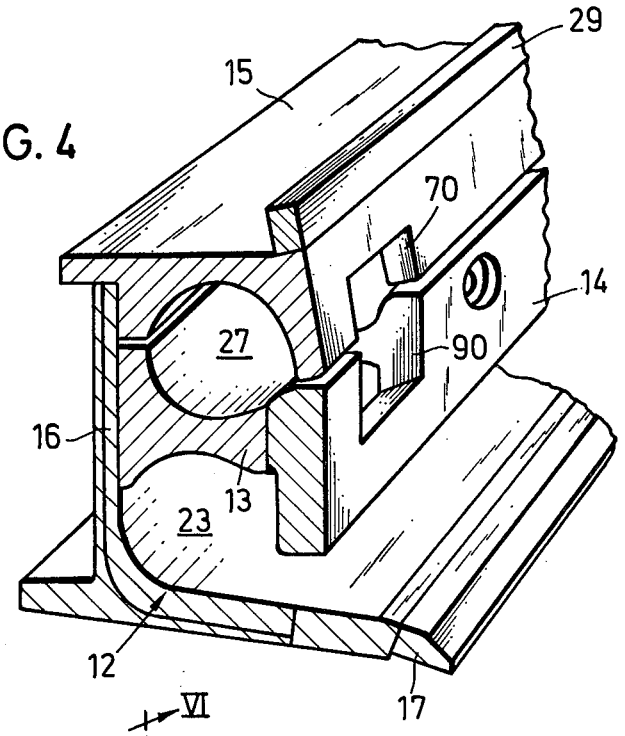
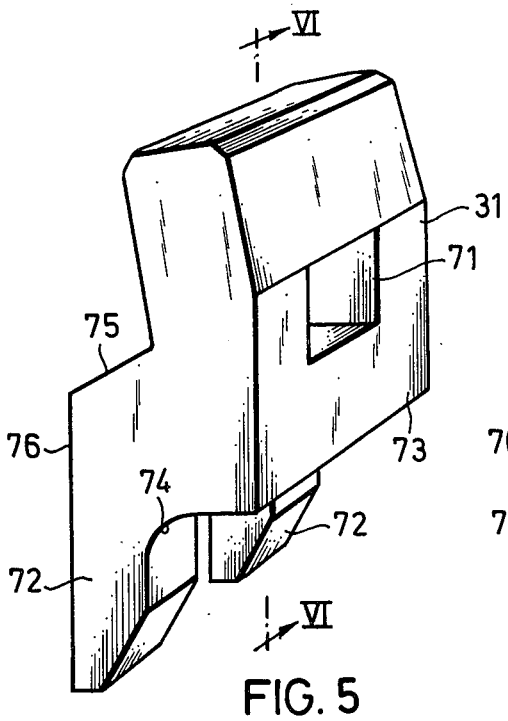
FIG. 5
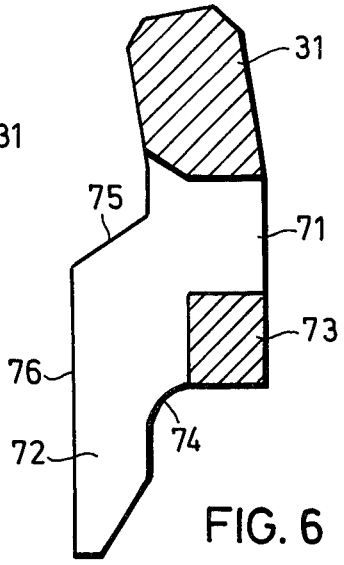
FIG. 6

GUIDES FOR MINERAL MINING MACHINES

BACKGROUND TO THE INVENTION

The present invention relates to guides for mineral winning and/or loading machines and particularly, but not solely, to guides for coal ploughs.

It is well known to attach various components to the mineral face side of a conveyor in an underground mine working to form a guide for a 'swordless' plough. The plough is usually driven with the aid of a chain running in upper and lower passages or channels at the mineral face side of the conveyor and protected within the guide. Spacers separate the upper and lower passages and pivotable covers serve to close off the upper passages. The covers are hinged at their lower sides so they can be swung outwards to expose the upper chain passage.

U.S. Pat. No. 4,108,495, for example, describes a guide of this known type. To permit the covers to be detached and assembled with ease, it is also known to construct the pivot joints as push-in pintle hinges with tongues projecting downwardly from the covers.

It is also known to provide a flat upper surface and guide rib on the covers to additionally guide the plough or to guide another machine.

A general object of the present invention is to provide an improved guide and guide assembly. More particularly, the invention seeks to improve the push-in pivot joints for the covers.

SUMMARY OF THE INVENTION

A guide constructed in accordance with the invention has means defining upper and lower passages along which a haulage chain is circulated and covers which cover at least the upper passage. The covers are pivoted at the lower region by push-in hinge joints which are provided with co-operating projections and recesses which interengage when the covers are in the closed position. As the covers are swung outwards from the closed position, the projections leave the recesses. The projections and recesses may have a rectangular profile, thus resembling a mortice and tenon.

Conveniently, the hinge joints are composed of components on the covers and on structures defining spacers separating the upper and lower passages and fixed to the mineral face side of a conveyor. These components can take the form of inserts welded into apertures in the lower region of the covers and in the structures. These components or inserts on the covers may have the recesses while the inserts on the structures may have the projections interengaging therewith. The inserts on the covers may each possess a pair of depending tongues which engage behind supports formed in pockets in the inserts on the structures. The supports then form bearing surfaces for radiused or curved surfaces of the inserts on the covers which then provide the pivoting action for the covers. The interengaging projections and recesses are preferably located above the supports.

The interengaging projections and recesses which characterize the invention ensure that the covers are secured in a particularly reliable manner when closed even when subjected to high operational forces. The covers are prevented from moving longitudinally of the conveyor by the projections and recesses while the covers cannot be lifted free of the push-in hinge joints. The covers can however be freed by pivoting them away from the conveyor to release the projections from the recesses and by lifting.

Conveniently, the inserts on the covers have rear surfaces which engage on surfaces inside the pockets of the complementary inserts when the covers are closed, while the tongues abut rear faces of the supports. The inserts on the structures may also have further stop surfaces inside their pockets which engage with inclined rear faces of the inserts on the covers when the covers are fully open to hold the covers in position.

The provision of tongues on the inserts of the covers and supports on the inserts of the structures separated by a gap in each case is helpful in permitting fine material, such as coal dust, to pass through the hinge joints. The pockets inside the inserts on the structures preferably communicate with openings at the lower surface of the inserts to permit such material to fall out of the hinge joints.

Conveniently, the inserts are stout forged or cast block-like piece parts and the apertures receiving them have a rectangular profile. Angle plates with lower surfaces supporting on plough driven by the aforesaid chain can be fixed with bolts to the mineral face side of the conveyor.

The structures are fixed to upstanding portions of the angle plates. The structures may each possess shaped parts constituting the spacers and a web which bridges the spacers and presents an outer surface more or less continuous with the covers. The structures may be integral or multi-part units connected to the upstanding portions of the angle plates. The apertures in the structures for receiving the pivot joint inserts can extend into both the webs and the spacers and inserts may each have an external face for merging with the spacers.

The webs of the structures can form a guide rail for the plough and the covers may have flat upper machine guide surfaces and ribs constituting another guide rail as is known per se. The ribs of the covers may have an outer surface nearest the mineral face which is coplanar with the outer surface of the cover extending at a slight angle to the vertical to thereby provide a steep ramp over which material can be loaded into the conveyor.

The covers can be secured in their closed position by releasable nuts and bolts locating between the covers and the upstanding portions of the angle plates. Positive location between the covers and the upstanding portions of the angle plates is provided when the covers are closed and recesses in the covers can receive the upper ends of the upstanding plate portions in the manner of a mortice and tenon.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings, wherein

FIG. 4 is a part sectional perspective view of the guide and guide assembly;

FIG. 5 is a perspective view of a component of a plug-in hinge joint associated with the guide and guide assembly;

FIG. 6 is a sectional view of the component shown in FIG. 5, the view being taken along the line VI—VI of FIG. 5;

DESCRIPTION OF PREFERRED EMBODIMENT

In general, a guide intended for guiding a mineral winning machine and more particularly, a coal plough is formed from guide assemblies or units arranged end-to-end and attached to the mineral, e.g. coal, face side of a scraper-chain conveyor. The conveyor is not shown in detail in the accompanying drawings but is composed in known manner of a series of channel sections or pans arranged end-to-end and preferably interconnected to permit some restricted movement therebetween. Each guide assembly or unit is allocated to one of the conveyor pans and has an overall length corresponding to that of the conveyor pans. The guide assemblies then combine to form a more or less continuous guide along which the machine or plough is moved to win mineral from the mineral face in an underground mine working.

Figure 1:
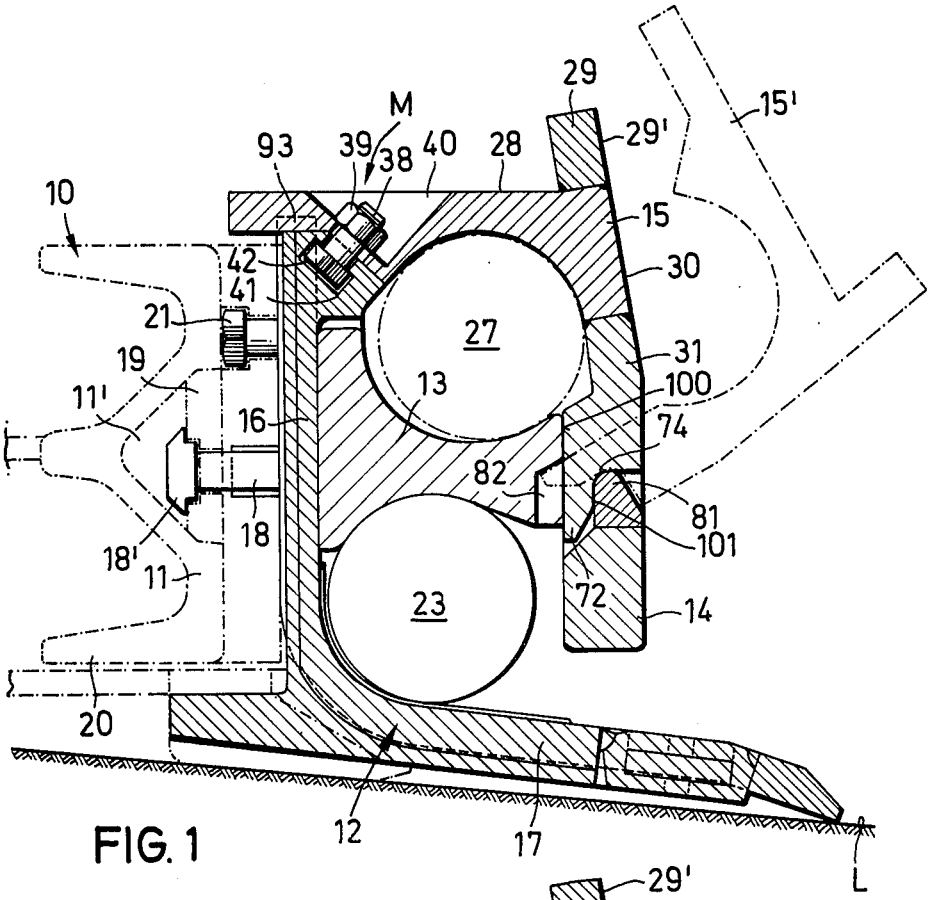
FIG. 1 is a sectional end view of a guide and guide assembly constructed in accordance with the invention.

In FIG. 1, the mineral face side wall of a conveyor pan 10 is denoted 11. The guide denoted M and the guide assemblies are essentially composed of L-shaped angle plates 12, spacers 13 and covers 15.

The angle plates 12, each have an upstanding portion 16 secured to the side wall 11 of an associated pan 10 and a lower outwardly projecting foot portion 17 which rests on the floor L of the working. The length of each plate 12 corresponds to the length of one of the pans 10 of the conveyor. The foot portions 17 of the plates 12 are slightly inclined in relation to the floor L and combine to form a ramp-like slideway slidably supporting the machine or plough. The foot portions 17 of the plates 12 are disposed below the lower flange 20 of the side walls 11 of the conveyor pans 10 so as to support the conveyor at the mineral face side. The foot portions 17 may also serve to limit the depth of cut of the plough. In this case, the portions 17 project beyond the plough body and engage on the mineral face at its juncture with the floor L to determine the depth of cut. The upstanding portions 16 of the plates 12 are secured to the conveyor pan side walls 11 with the aid of bolts 18, 21.

In known manner, the heads 18' of the bolts 18 locate in retention pockets defined by holders 19 fixed as by welding into the normal V-shaped grooves 11' in the exterior of the conveyor pan side walls 11.

Figure 3:
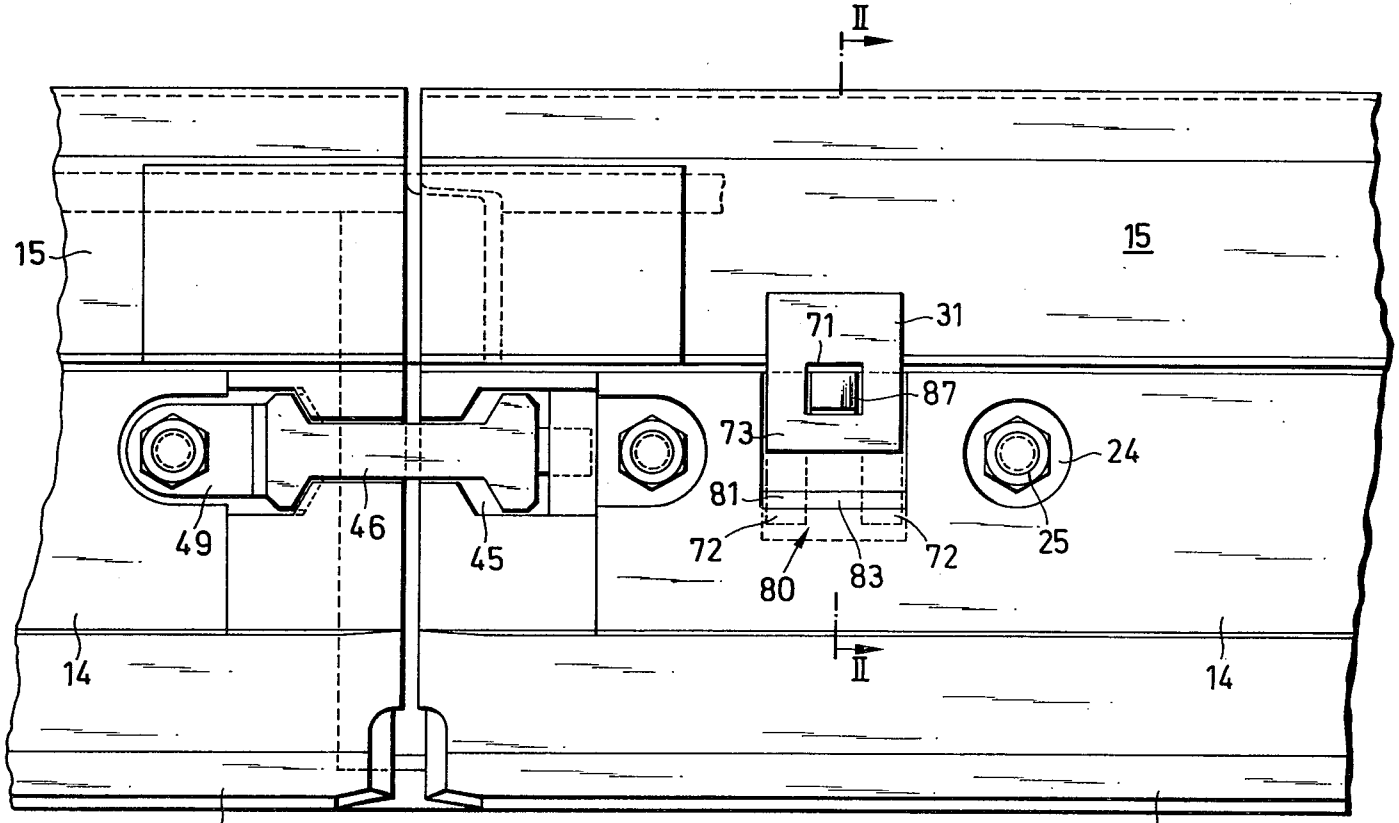
FIG. 3 is an elevation of part of the guide and guide assembly depicted in FIG. 1.

Each pan 10 and guide assembly has in addition to the angle plate 12, a structure defining a pair of spacers 13. Each spacer 13 has a length somewhat less than half the length of the pan 10 so that the spacers 13 of each guide assembly are spaced apart with a gap therebetween. The structure forming the spacers 13 is fixed to the side wall 11 of the associated pan 10 by means of the bolts 18 which extend through bores in the spacers 13. The outer face of the structure defining the spacers 13 nearest the mineral face is provided with recesses 24 which receive nuts 25 engaged with the bolts 18 (FIG. 3). The spacers 13 of each guide assembly are interconnected by a web plate 14 which interconnects and bridges the spacers 13.

The web plate 14 forms a lower region of the structure and extends continuously over the entire length of the pan and hence the guide assembly. Instead of providing integral structures defining the spacers 13 and the webs 14, it is possible to construct these structures from separate parts, i.e. a pair of spacers 13 and a plate or bar forming the web 14, which are then interconnected by welding or by screws or bolts, for example. The web plates 14 of the guide assemblies provide a lower guide rail for the plough. The web plates 14 are spaced from the portions 17 of the angle plates 12 to form a slot.

The plough has one or more arms which project through this slot and connect with one or more guide blocks which engage around the webs 14 in the manner of a hook.

The spacers 13 separate and partly define an upper and a lower passage or channel 27, 23 in which a chain used to propel the plough is circulated. The lower run of the chain located in the lower channel 23 forms a haulage run and this lower run is connected to the plough via the guide block (s) and guide arm (s). The upper run of the chain located in the upper channel 27 forms the return run. The gaps between the spacers 13 permit access to the lower channel 23.

Each guide assembly associated with one of the conveyor pans 10 has at least one cover 15. Each cover 15 has a comparatively wide flat upper support surface 28 which is approximately horizontal. An upwardly projecting rib 29 delimits the surface 28 in the direction towards the working face. The width of each of the ribs 29 is small in relation to the associated support surface 28.

The covers are each mounted for pivoting between open and closed positions. FIG. 1 shows one of the covers 15 in its closed position and the chain-dotted line reference 15' signifies a cover which is being pivoted towards the mineral face to adopt its open position.

In their closed positions, the covers 15 close off the upper channel 27 and the support surface 28 and the ribs 29 combine to form another guide surface and rail for the plough or for some other machine. As with the lower rail constituted by the webs 14, the plough or other machine may have one or more arms or the like which engage in hook-like manner over the ribs 29 of the covers 15.

Each cover 15 has a somewhat T-shaped cross-section with the 'cross-piece' of the 'T' generally upstanding when the cover 15 is closed. The rib 29 of the cover 15 forms part of the region of the cover 15 constituting the cross-piece. The outer faces 30 of these cross-piece regions of the covers 15, including the outer surfaces 29' of the ribs 29, is inclined at a small angle to the vertical when the covers 15 adopt the closed position. The covers 15 have rectangular apertures 70 (FIG. 4) at the lower end parts of these regions which receive inserts 31 (FIGS. 5 and 6).

The inserts 31 can be forged components welded into the apertures 70 and co-operate with similar inserts 80 in the structures defining the spacers 13 to provide hinges permitting the covers 15 to be pivoted between their open and closed positions. As shown in FIGS. 5 and 6, each insert 31 has a central rectangular aperture 71 and a pair of lower projections or tongues 72. The projections 72 have a reduced thickness relative to the main body 73 of the insert 31. The projections 72 merge smoothly with the body 73 at a curved surface 74. The rear side of the insert 31 has an upstanding surface 76 and an inclined surface 75.

Figure 7:
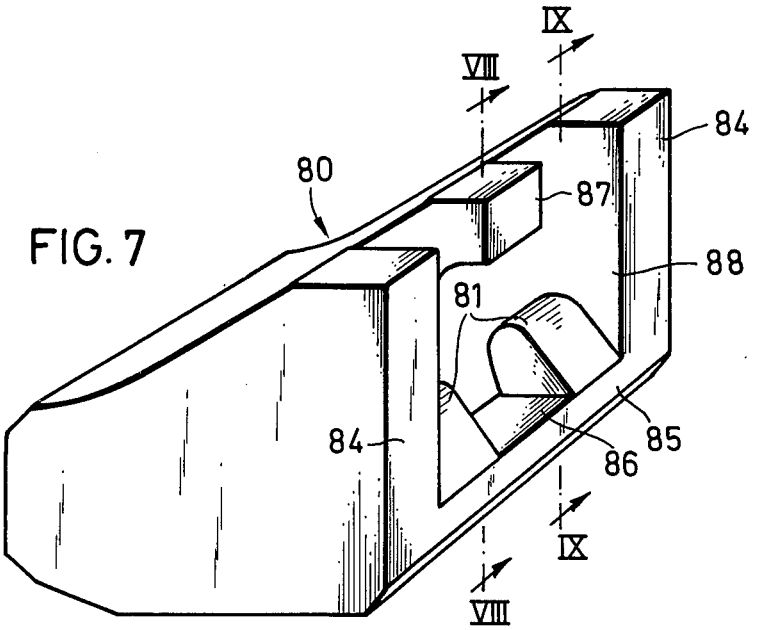
FIG. 7 is a perspective view of another component of the plug-in hinge joint.
Figure 8:
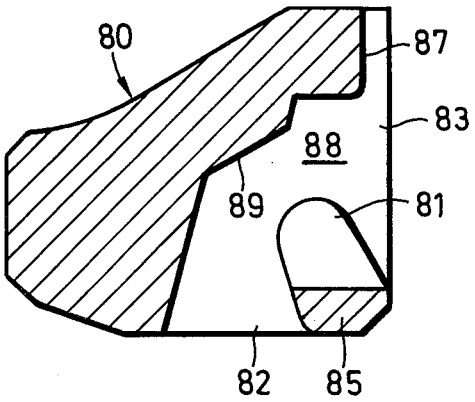
FIG. 8 is a sectional view of the component shown in FIG. 7, the view being taken along the line VIII—VIII of FIG. 7.

The web 14 of the structure defining the spacers 13 is likewise provided with apertures 90 (FIG. 4) which receive the inserts 80 (FIGS. 7–8). The inserts 80 can also be forged components welded into the apertures 90.

Figure 2:
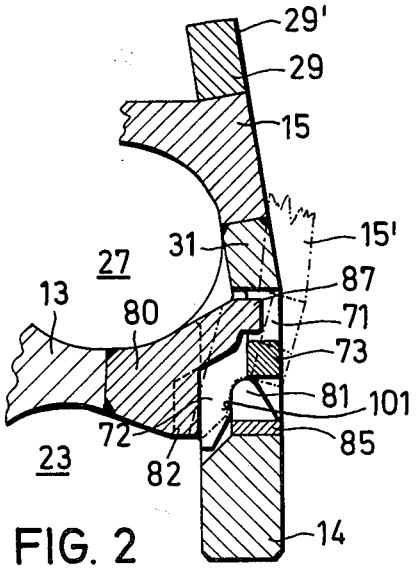
FIG. 2 is a sectional end view of part of the guide assembly, the view being taken along the line II—II of FIG. 3.
Figure 9:
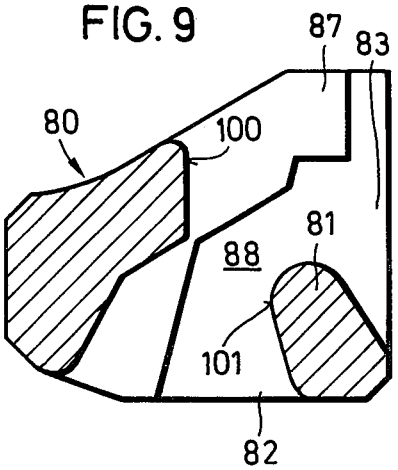
FIG. 9 is a sectional view of the component shown in FIG. 7, the view being taken along the line IX—IX of FIG. 7.

As shown in FIGS. 7 to 9, each insert 80 has an opening 82 which communicates with the lower chain channel 23 as can be seen in FIGS. 1 and 2.

A central shaped pocket 88 in the insert 80 serves to locate and receive one of the inserts 31 of the cover 15 associated therewith.

The insert 80 has outer end webs 84, separated by an opening 83 and bridged by a flat lower web 85. The webs 84, 85 collectively define flat outer surfaces for the insert 80. A pair of inclined curved supports 81 extend upwardly from the web 85 with a gap 86 therebetween. The supports 81 are shaped to mate with the curved surface 74 of the insert 31 fitting thereon with the projections 72 positioned behind the supports 81 in contact with the rear faces 101 thereof.

Above the gap 86, the insert 80 is provided with a projection 87 which locates within the aperture 71 of the insert 31 when the associated cover 15 is closed. The pocket 88 is delimited inwardly of the insert 80 by a shaped surface with various inclined flat portions as shown in FIGS. 8 and 9. The inclined surface portion 89 forms a stop surface engageable with the rear inclined surface 75 of the insert 31, while the surface 100 is engageable with the rear surface 76 of the insert 31. The apertures 90 (FIG. 4) which receive the inserts 80 extend into the spacers 13 and the inserts 80 have curved external rear surfaces which merge with the spacers 13.

It is desirable to provide a single cover 15 for each guide assembly although this is not essential. Each cover 15 then has two inserts 31, each near one its ends which fit into the inserts 80 fitted to the structure defining the spacers 13 of the guide assembly as described. The hinges formed by the interengaging inserts 31, 80 are push-in hinges permitting the cover 15 to be pivoted or lifted for release. During assembly, the cover 15 is held in its partly open position (15′ FIG. 1) and the projections or tongues 72 of the inserts 31 are located in the pockets 88 of the inserts 80 behind the supports 81 to bring the surfaces 74 onto the supports 81.

The supports 81 then permit the cover 15 to be pivoted to its closed position whereupon the projections 87 locate in the aperture 71. In the closed position the rear faces 76 of the inserts 31 engage on the surfaces 100 of the inserts 80, while the front faces of the projections 71 engage the rear surfaces 101 of the supports 81.

When the cover 15 is pivoted forwardly to its fully open position the projections 87 leave the apertures 71 and the rear surfaces 75 abut the stop surfaces 89 to hold the cover 15 reliably in position. The cover 15 can easily be lifted free of the inserts 80.

The covers 15 are detachably secured in their closed position with the aid of short bolts 38 as shown in FIG. 1. As illustrated in FIG. 1, the upstanding portions 16 of the angle plates 12 are provided with bearing pieces 41 which can, for example, take the form of continuous bars or short bar sections welded to the portions 16 of the plates 12.

These pieces 41 have recesses 42 which are shaped to retain the heads of the bolts 38. The threaded stems of the bolts 38 extend through bores in webs provided at the underside of the covers 15 beneath their upper surfaces 28. These webs also have recesses 40 communicating with the bores and accessible from the upper surfaces 28. The recesses 40 accommodate nuts 39 engaged on the threaded stems of the bolts 38. In order to swing the covers 15 to their open position, or to remove the covers 15, it is first necessary to release the nuts 39 and when the covers 15 are swung forward the bolts 38 can be removed, if desired. When the covers 15 are in their closed position, the webs providing the bolt-reception bores and recesses 40 engage on the bearing pieces 41. The covers 15 project over the upper end of the portions 16 and also engage thereon when the covers 15 adopt the closed position. The covers 15 are thus supported by the upstanding portions 16 of the plates 12. In addition, the undersides of the covers 15 are recessed to locate with the upper ends of the plate portions 16 in the manner of a mortice and tenon joint 93.

The guide assemblies are connected together with the aid of connection means which resist traction forces along the conveyor but permit slight displacements in both the vertical and horizontal directions. The connection means can be used in addition to the joints connecting the conveyor pans together although the latter joints can be omitted at the face side.

FIG. 3 depicts one of the connection means for the guide assemblies. As illustrated, the structures defining the spacers 13 and webs 14 are provided at their ends with pockets or compartments 45 which receive a toggle member 46. The toggle member 46 has an H-shaped profile with a central region and enlarged end regions.

One end region of the toggle member 46 has an axial bore which receives a fixing pin engaging behind a rear wall surface of one of the pockets 45. The other end region of the toggle member has a projection which locates behind a similar rear wall surface of the other pocket 45.

A locking plate 49 locates with the other end region of the member 46 to retain the latter in the pockets 45. The plate 49 is attached to one of the structures 13, 14 with the aid of a bolt or screw and the toggle member 46 can be released by removal of the plate 49 and by displacing the member 46 to the left of FIG. 3 to release the pin. The toggle joints 45, 46 are readily accessible from the mineral face side of the guide.

We claim:

1. In a guide for mineral mining; said guide comprising means defining upper and lower passages along which a drive chain is to be circulated, said defining means including spacers separating the upper and lower passages, and covers which close off the upper passage and which are pivotable outwardly from the upper passage to an open position; the improvement comprising push-in pivot joints provided for the covers which permit the covers to be pivoted between the closed and open positions and to be detached by lifting, and cooperating projection means and recess means for interengaging when the covers adopt the closed position to prevent detachment of the covers by lifting, and to become disengaged as the covers are pivoted to the open position to permit the covers to be detached by lifting.

2. A guide according to claim 1, wherein structures provide the spacers and the pivot joints are formed by complementary components on the covers and on the structures.

3. A guide according to claim 2, wherein the components of the pivot joints are inserts fitted into apertures in the lower regions of the covers and in the structures.

4. A guide according to claim 2, wherein the pivot joint components on the covers are provided with depending tongues which engage behind shaped supports formed in pockets in the pivot joint components on the structures; the components on the covers having surfaces which engage on the supports acting as bearings for the pivotal action.

5. A guide according to claim 4, wherein the pivot joint components on the covers have rear surfaces which engage on surfaces in the pockets of the pivot joint components on the structures when the covers adopt the closed position.

6. A guide according to claim 4, wherein the interengageable projections and recesses are positioned above the supports.

7. A guide according to claim 1, wherein the interengaging projections and recesses have a rectangular cross-sectional profile.

8. A guide according to claim 4, wherein the pivot joint components on the structures have stop surfaces inside the pockets which engage with rear faces of the pivot joint components on the covers to limit the pivotal movement of the covers and to define the open position.

9. A guide according to claim 4, wherein the front faces of the tongues engage on rear faces of the supports when the covers adopt the closed position.

10. A guide according to claim 4, wherein the pockets in the components on the structures communicate via openings in the lower surfaces of the components with the lower chain passage.

11. A guide according to claim 2, and further comprising angle plates with surfaces forming a lower support for a plough driven by the chain, the angle plates being fitted to the mineral face side of a conveyor and the structures being fitted to upstanding portions of the angle plates.

12. A guide according to claim 11, wherein the covers engage with the upstanding portions of the angle plates when in the closed position and means is provided to detachably secure the covers to the upstanding portions of the angle plates, thereby to lock the covers in the closed position.

13. A guide according to claim 12, wherein the upstanding portions of the angle plates locate in recesses in the covers when the covers are in the closed position.

14. A guide according to claim 12, wherein the structures which provide the spacers have shaped parts constituting the spacers and webs extending therebetween, the webs having external faces which merge with external faces of the covers when the covers are in the closed position and providing a lower guide rail for the plough and wherein the covers have flat upper surfaces delimited by ribs which form another guide surface and another guide rail.

15. A guide assembly for attachment to a side wall of a conveyor to form part of a mineral winning machine guide; said guide assembly comprising an angle plate with an upstanding portion for fixing to the side wall and a lower portion for supporting the machine, a structure fixed to the upstanding portion of the angle plate and including spacers which serve to separate an upper and lower chain guide passages disposed alongside the upstanding portion of the angle plate and at least one cover pivotably mounted to said structure and serving to close off the upper chain guide passage, said cover being movable away from the upstanding portion of the angle plate to an open position permitting access to the upper chain guide passage; wherein co-operating components on the cover and the structure provide push-in hinge joints which permit the cover to be pivoted between the closed and open positions and to be detached by lifting, and mating projection means and recess means for locking together only when the cover is in the closed position to prevent the cover from being detached by lifting.

* * * * *